US006873119B2

(12) United States Patent
Kim et al.

(10) Patent No.: US 6,873,119 B2
(45) Date of Patent: Mar. 29, 2005

(54) NON-ROTATING ELECTRODELESS HIGH-INTENSITY DISCHARGE LAMP SYSTEM USING CIRCULARLY POLARIZED MICROWAVES

(75) Inventors: Jin-Joong Kim, Seoul (KR); Jeong-Won Kim, Kyeongki-do (KR); Kyoung-Sub Oh, Chunla-do (KR)

(73) Assignee: Taewon Electronic Co., Ltd., Seoul (KR)

( * ) Notice: Subject to any disclaimer, the term of this patent is extended or adjusted under 35 U.S.C. 154(b) by 0 days.

(21) Appl. No.: 10/677,534

(22) Filed: Oct. 3, 2003

(65) Prior Publication Data

US 2004/0239261 A1 Dec. 2, 2004

(30) Foreign Application Priority Data

Jun. 2, 2003 (KR) ..... 10-2003-0035343

(51) Int. Cl.[7] ..... H05B 41/16

(52) U.S. Cl. ..... 315/248; 315/39; 315/344; 313/637; 313/638

(58) Field of Search ..... 315/248, 39, 344, 315/267; 313/567, 571, 637, 638; 118/723 MW; 156/345.41; 204/298.38

(56) References Cited

U.S. PATENT DOCUMENTS

| | | | | | |
|---|---|---|---|---|---|
| 5,111,111 | A | * | 5/1992 | Stevens et al. | 315/111.41 |
| 5,227,698 | A | | 7/1993 | Simpson et al. | 315/248 |
| 5,367,226 | A | | 11/1994 | Ukegawa et al. | 315/248 |
| 6,137,237 | A | * | 10/2000 | MacLennan et al. | 315/248 |
| 6,476,557 | B1 | | 11/2002 | Leng et al. | 313/637 |

* cited by examiner

*Primary Examiner*—Haissa Philogene
(74) *Attorney, Agent, or Firm*—Young & Thompson

(57) ABSTRACT

A non-rotating electrodeless high-intensity discharge lamp system using circularly polarized microwaves. The lamp system has a first rectangular waveguide to propagate linearly polarized microwaves generated from a microwave source; an input circular waveguide linearly connected to the first rectangular waveguide; a second rectangular waveguide closed at an end thereof, and perpendicularly connected to a circumferential surface of the input circular waveguide; an elliptical waveguide linearly connected to the input circular waveguide such that the major axis of the elliptical waveguide is rotated to a predetermined angle relative to a horizontal surface of the input rectangular waveguide; a second circular waveguide linearly connected to the elliptical waveguide; and a discharge lamp housed in a mesh cover, and supported by the second circular waveguide while being held on a reflecting mirror.

5 Claims, 4 Drawing Sheets

【FIG. 1】
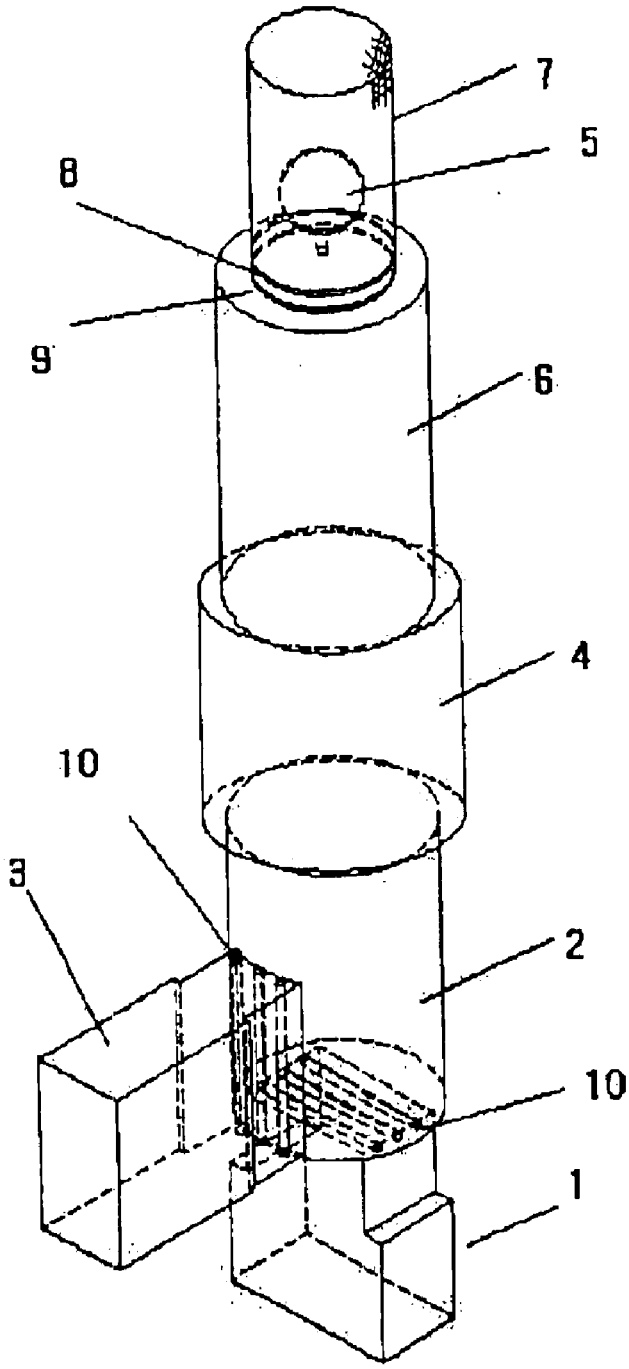

【FIG. 2a】
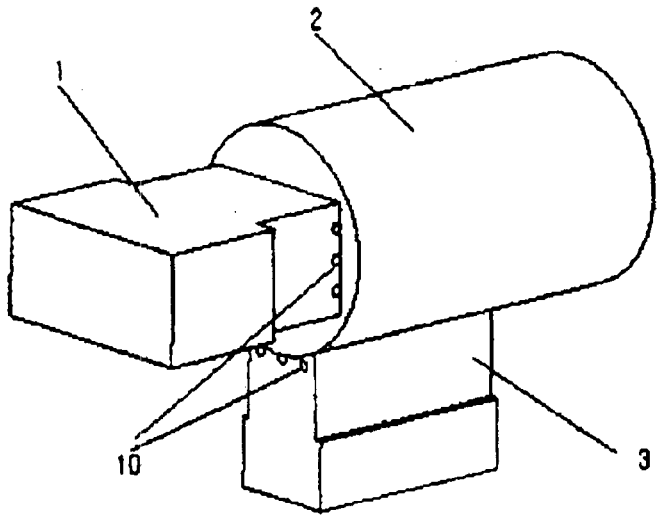
【FIG. 2b】
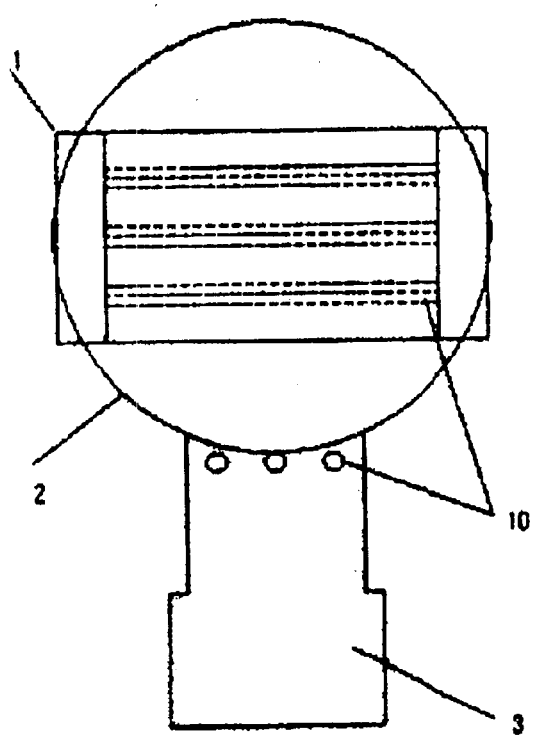

【FIG. 3a】
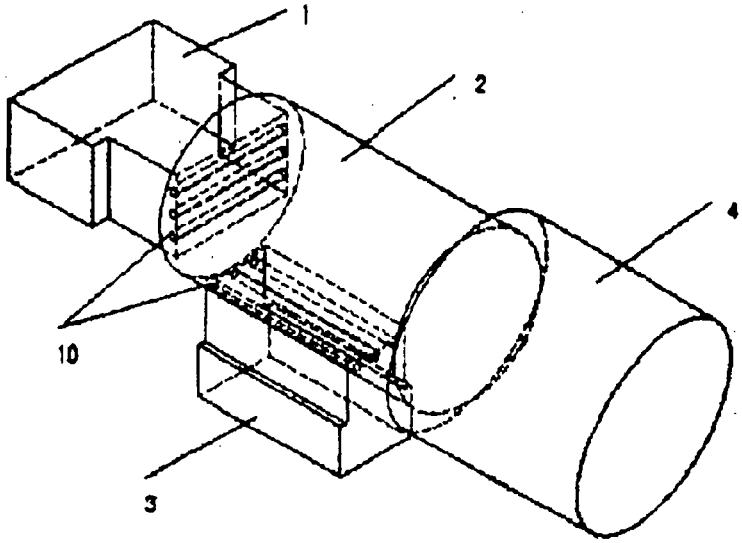
【FIG. 3b】
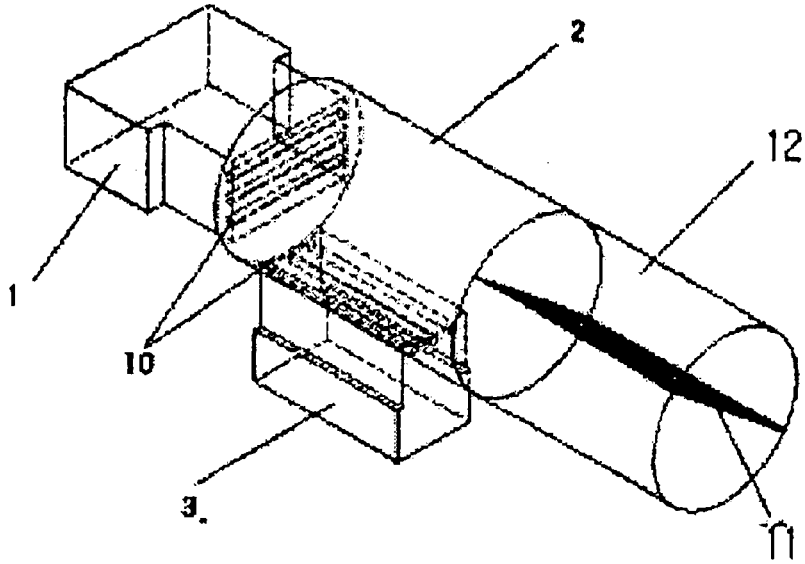

【FIG. 4】
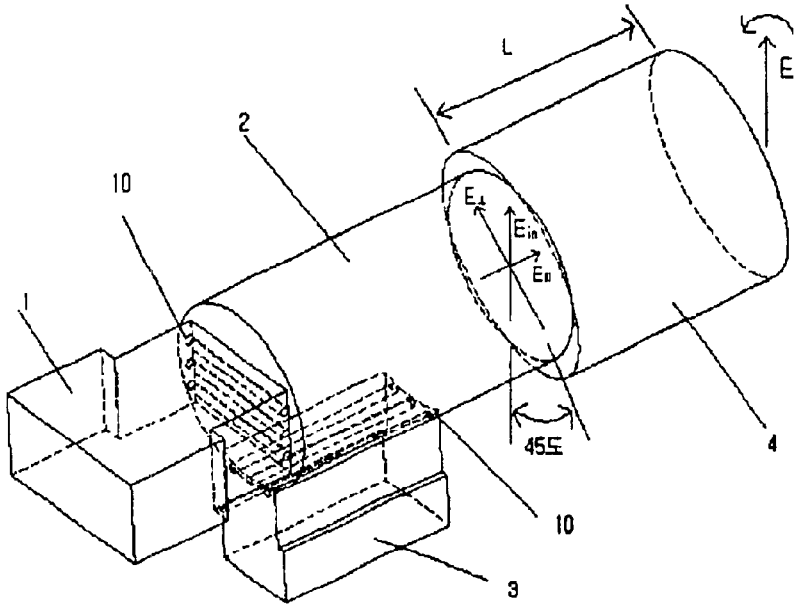
【FIG. 5】
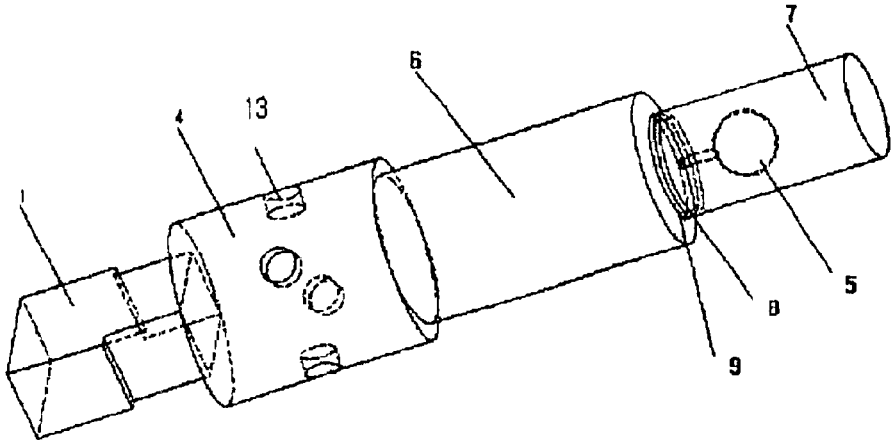

NON-ROTATING ELECTRODELESS HIGH-INTENSITY DISCHARGE LAMP SYSTEM USING CIRCULARLY POLARIZED MICROWAVES

BACKGROUND OF THE INVENTION

1. Field of the Invention

The present invention relates, in general, to non-rotating electrodeless high-intensity discharge lamp systems using circularly polarized microwaves and, more particularly, to a non-rotating electrodeless high-intensity discharge lamp system using circularly polarized microwaves, which comprises a waveguide array to propagate microwaves to a discharge lamp therethrough, with an elliptical waveguide arranged in the waveguide array such that the major axis of the elliptical waveguide is rotated to a predetermined angle relative to the horizontal surface of an input waveguide, thus converting linearly polarized microwaves into circularly polarized microwaves due to the rotated angle of the elliptical waveguide relative to the horizontal surface of the input waveguide, and thereby allowing the circularly polarized microwaves to reach the discharge lamp.

2. Description of the Related Art

Generally, an electrodeless high-intensity discharge lamp system excites a circular cavity to the $TE_{11}$ mode, which is the dominant mode in the circular cavity. Therefore, the microwaves that are transmitted from a rectangular waveguide to a circular cavity that contains a lamp are almost linearly polarized. When the fill in the lamp is discharged by linearly-polarized microwaves, the luminous plasma is formed in the shape of ellipsoid prolate in the direction of the $TE_{11}$ mode fields. Accordingly, even when the plasma completely fills the entire space inside the discharge lamp, the parts of the lamp that are in contact with the polar zones of the prolate ellipsoidal plasma becomes overheated in the case of an electrodeless high-intensity discharge lamp. Thus, the overheated parts of the lamp are easily punctured or damaged.

In an effort to overcome the above-mentioned problem experienced in the prior art electrodeless high-intensity discharge lamp system, the lamp is rotated using a driving motor. However, the microwave discharge lamp system having such a driving motor requires a complex structure to connect the lamp to the driving motor, thus having a large size and thereby adding expense to the system and reducing reliability. Furthermore, the driving motor will increase the system maintenance frequency due to its shortened lifespan. In order to circumvent the problem of the discharge lamp system having a driving motor, several techniques were proposed to rotate the microwave fields themselves by converting the linearly polarized microwaves into circularly polarized microwaves, as disclosed in U.S. Pat. No. 5,367,226.

In the related art, several methods to circularly polarize the microwaves have been known to those skilled in the art. In the first method as disclosed in U.S. Pat. No. 5,227,698, the waveguide through which the microwaves are propagated to a discharge lamp is divided at a portion thereof into two branches so as to cause a differential phase shift of 90° between two electromagnetic field components in the two branches, and to produce circularly polarized microwaves by combining the two electromagnetic field components with each other. In the second method as disclosed in U.S. Pat. No. 6,476,557, a dielectric material is inserted in a microwave cavity in which a discharge lamp is disposed, so that the dielectric material induces a different phase velocity for the two modes of the coupled microwaves in the cavity. The two orthogonal modes are propagated at different phase velocities and, when combined at the cavity, produce circularly polarized electromagnetic fields in the microwave cavity. In another embodiment of the prior art as disclosed in U.S. Pat. No. 6,476,557, circular polarization is provided from a microwave circuit inserted between a source of microwave power and a cylindrical cavity containing an electrodeless lamp.

However, since the first of the above-mentioned techniques force the electromagnetic fields of the microwaves while decomposing the electromagnetic fields into two orthogonal components, the techniques are problematic as follows. That is, the first technique in which the waveguide is divided into the two parallel branches with different lengths to cause the differential phase shift of 90° between the two orthogonal components of the electromagnetic fields in the two branches, is problematic in that the technique undesirably increases complexity of the structure of the discharge lamp system, complicating the production process of the lamp system and adding expense. Also, it is not easy to stabilize the microwave mode in such devices owing to the interaction between waves that are reflected at the multiple ports. In the second technique, the dielectric material is disposed in the microwave cavity to induce different phase velocity for the two modes of the microwave fields, thereby producing circularly polarized electromagnetic fields in the microwave cavity. The second technique is problematic in that the circular cavity with dielectric material does not set up circularly polarized fields because the waves that is circularly polarized in the initial propagation is reflected back by the end plate of the cavity and it changes the sense of rotation. When such waves are reflected by the first plate which has a coupling aperture, they will have circular polarization in the opposite sense compared to the initial waves, thus restoring the linear polarization. In addition, the use of additional material will add expense and increase the structure of the system.

SUMMARY OF THE INVENTION

Accordingly, the present invention has been disclosed keeping in mind the above problems occurring in the related art, and the objective of the present invention is to provide a non-rotating electrodeless high-intensity discharge lamp system using circularly polarized microwaves in a simpler way. In this invention, circular polarization is achieved by propagating the microwaves through an elliptical waveguide arranged in the waveguide array such that the major axis of the elliptical waveguide is rotated to a predetermined angle relative to a horizontal surface of the input waveguide, thus converting linearly polarized microwaves into circularly polarized microwaves by the difference in the phase velocities of the two components of the waves, which are polarized along the major axis and the minor axis, respectively, when the two waves emerges out of the elliptical waveguide and combined before reaching the discharge lamp.

In order to achieve the above objective, according to one aspect of the present invention, there is provided a non-rotating electrodeless high-intensity discharge lamp system using circularly polarized microwaves, comprising a first rectangular waveguide to propagate linearly polarized microwaves generated from a microwave source such as a magnetron, with an input circular waveguide, an elliptical waveguide, and a second circular waveguide sequentially and linearly connected to the rectangular waveguide. In such a case, the elliptical waveguide is linearly connected to the input circular waveguide such that the major axis of the elliptical waveguide is rotated to a predetermined angle relative to a horizontal surface of the input circular waveguide. The rotated angle of the major axis of the elliptical waveguide is preferably set at 45°.

BRIEF DESCRIPTION OF THE DRAWINGS

The above and other objects, features and other advantages of the present invention will be more clearly understood from the following detailed description when taken in conjunction with the accompanying drawings, in which:

FIG. 1 is a perspective view illustrating a non-rotating electrodeless high-intensity discharge lamp system using circularly polarized microwaves, according to an embodiment of the present invention;

FIG. 2*a* is a perspective view illustrating a waveguide array with two rectangular waveguides and one input circular waveguide of FIG. 1;

FIG. 2*b* is a plane view of the waveguide array of FIG. 2*a* to illustrate mode filters provided on the interface of the rectangular and circular waveguides;

FIG. 3*a* is a perspective view illustrating an elliptical waveguide connected to the input circular waveguide of the waveguide array of FIG. 2*a* to produce the circularly polarized microwaves;

FIG. 3*b* is a perspective view illustrating a circular polarizer with a dielectric plate connected to the input circular waveguide of the waveguide array of FIG. 2*a* to produce the circularly polarized microwaves;

FIG. 4 is a perspective view of the discharge lamp system having the elliptical waveguide connected to the input circular waveguide of the waveguide array of FIG. 2*a*, which illustrates the conversion of linearly polarized microwaves into the circularly polarized microwaves; and FIG. 5 is a perspective view illustrating a non-rotating electrodeless high-intensity discharge lamp system using circularly polarized microwaves, according to another embodiment of the present invention.

DETAILED DESCRIPTION OF THE INVENTION

Reference will now be made in detail to a preferred embodiment of the invention, an example of which is illustrated in the accompanying drawings. Wherever possible, the same reference numerals will be used throughout the drawings and the description to refer to the same or like parts.

FIG. 1 is a perspective view illustrating a non-rotating electrodeless high-intensity discharge lamp system using circularly polarized microwaves, according to an embodiment of the present invention. As shown in FIG. 1, the non-rotating electrodeless high-intensity discharge lamp system according to the first embodiment of the present invention includes the first rectangular waveguide 1 to transmit linearly polarized microwaves generated from a microwave source which is a magnetron. An input circular waveguide 2 is linearly connected to an end of the first rectangular waveguide 1. The second rectangular waveguide 3, which is closed at an end thereof, is perpendicularly connected to a circumferential surface of the input circular waveguide 2. The second rectangular waveguide 3 functions to balance the circularly polarized microwaves which are produced from the linearly polarized microwaves, as will be described later herein. An elliptical waveguide (the so called quarter-wave plate) 4 is linearly connected to an end of the input circular waveguide 2. In addition, the second circular waveguide 6 is linearly connected to the elliptical waveguide 4.

A mesh or perforated or apertured cover 7, in which a discharge lamp 5 is disposed, is mounted to an end of the second circular waveguide 6. The mesh cover 7 is preferably made of a conductive material which can contain microwaves but can transmit the visible light. In the mesh cover 7, the discharge lamp 5 is securely held on a reflecting mirror 9 which reflects light from the lamp 5. The reflecting mirror 9 preferably comprises a quartz plate 8. The discharge lamp 5 is thus stably supported by the second circular waveguide 6.

FIG. 2*a* illustrates a waveguide array with the two rectangular waveguides 1 and 3 and the input circular waveguide 2. FIG. 2*b* illustrates mode filters provided on the interface of the rectangular and circular waveguides of the array. In the waveguide array of FIGS. 2*a* and 2*b*, the first rectangular waveguide 1 transmits the linearly polarized microwaves in $TE_{10}$ mode generated by the magnetron, while the input circular waveguide 2 is excited to the $TE_{11}$-mode and propagates the microwaves therethrough. As shown in FIG. 2*a*, the waveguide array is appropriately matched, with a frequency band which is wider than that of the microwaves generated by the magnetron, by changing the widths and heights of the first and second rectangular waveguides 1 and 3. In addition, a mode filter 10 is provided on the interface between the input circular waveguide 2 and the first and second rectangular waveguides 1 and 3, as shown in FIG. 2*b*. The mode filter 10 allows only the microwaves of a narrow frequency band to pass therethrough, so that only the electromagnetic field components of a frequency band capable of producing the circularly polarized microwaves are propagated into the input circular waveguide 2.

FIGS. 3*a* and 3*b* are views showing two different waveguide arrays to produce circularly polarized microwaves, according to the present invention. In the waveguide array of FIG. 3*a*, the elliptical waveguide 4 is connected to the input circular waveguide 2 such that a major axis of the elliptical waveguide 4 is rotated to a predetermined angle relative to the horizontal surface (or the wider surface) of the rectangular waveguide 1. In the waveguide array of FIG. 3*b*, a waveguide 12, in which a dielectric material 11 having a predetermined thickness and dimension is disposed, is connected to the input circular waveguide 2. In such a case, a ceramic plate is preferably used as the dielectric material 11.

FIG. 4 is a perspective view of part of the discharge lamp system having the elliptical waveguide 4 connected to the input circular waveguide 2 of FIG. 2*a*, which illustrates the conversion of the linearly polarized microwaves into the circularly polarized microwaves. In a detailed description, when the linearly polarized microwaves are propagated through the elliptical waveguide 4, there results a difference in the propagation velocities of the two components of the microwaves, one axially propagated with polarization in the major axis and the other axially propagated with polarization in the minor axis of the elliptical waveguide 4. When a differential phase shift of 90° is resulted between the two microwave components, the linearly polarized microwaves are converted into the circularly polarized microwaves when the microwaves emerge the elliptical waveguide to reach the discharge lamp 5. In such a case, the electric fields rotate at the discharge lamp 5.

In the waveguide array of FIG. 3*b*, the helicity of the microwaves, that is the sense of rotation, rotates clockwise or counterclockwise in accordance with the direction of the dielectric plate 11 in the dielectric waveguide 12, so that the microwaves are circularly polarized to form the circularly polarized microwaves when they reach the discharge lamp 5.

When the microwaves generated by the magnetron are transmitted into the elliptical waveguide 4, the microwaves are transmitted with a predetermined angle of rotation. In such a case, it is necessary to decompose the microwaves into the major-axis component and the minor-axis component and to have a 90°-phase difference resulted between the two microwave components so that the desired circularly polarized microwaves are produced. In such a case, since the elliptical waveguide is connected to the input circular waveguide, the more of the major-axis component of the microwaves is transmitted than the minor-axis component. It is thus necessary to balance the major- and minor-axis components of the microwaves by appropriately adjusting the length of the second rectangular waveguide 3 having a closed end plate, which is perpendicularly connected to the circumferential surface of the input circular waveguide 2.

FIG. 5 is a perspective view illustrating a non-rotating electrodeless high-intensity discharge lamp system using circularly polarized microwaves, according to another embodiment of the present invention. In the discharge lamp system of FIG. 5, the input circular waveguide 2 and the second rectangular waveguide 3 having the closed end are removed from the waveguide array, while the elliptical waveguide 4 is linearly and directly connected to the first rectangular waveguide 1 which transmits the microwaves generated by the magnetron into the elliptical waveguide 4. In such a case, the elliptical waveguide 4 is linearly and directly connected to the rectangular waveguide 1 such that the major axis of the elliptical waveguide 4 is rotated to a predetermined angle relative to a horizontal surface of the rectangular waveguide 1. In addition, four stubs 13 are inserted into the circumferential surface of the elliptical waveguide 4. It is preferable to insert two stubs 13 at the major-axis part and insert two stubs 13 at the minor-axis part, thus balancing the circularly polarized microwaves.

In the present invention, the predetermined angle at which the major axis of the elliptical waveguide 4 is rotated relative to the horizontal surface of the input waveguide, is preferably set to 40~50° when the elliptical waveguide 4 has a minor-axis diameter of 80 mm and a major-axis diameter of 108 mm for microwaves of frequency of 2.45 GHz.

In addition, the discharge lamp system of the present invention is also advantageous in that the linearly polarized microwaves are propagated through the waveguide array before a discharge is created between the electrodes of the lamp 5, and the linearly polarized microwaves are converted into the circularly polarized microwaves after the discharges are sustained in the lamp 5.

Before the discharges are initiated in the lamp 5, the microwaves are reflected by the conductive surface of the lamp system, and the helicity (or sense of rotation) of the reflected microwaves is oppositely changed to pass the lamp 5 for the second time. That is, the direction of rotation of the reflected microwaves around the lamp 5 when the microwaves pass the lamp 5 for the second time, remains the same as that of the microwaves passing the lamp 5 for the first place. The circularly polarized microwaves, which are not absorbed while the microwaves pass the lamp 5 for the second time, pass the elliptical waveguide 4 to reach the input circular waveguide 2. In such a case, the reflected circularly polarized microwaves are converted into linearly polarized microwaves of which the polarization plane is perpendicular to the polarization plane of the initial input polarized microwaves. That is, the electric field of the reflected microwaves is propagated parallel to the horizontal surface.

The microwaves which are reflected by the interface of the input circular waveguide 2, are converted by the waveguide array into circularly polarized microwaves of which the helicity is opposite to that of the initially produced circularly polarized microwaves. The reflected circularly polarized microwaves interfere with the initially produced circularly polarized microwaves, so as to produce the linearly polarized microwaves again.

Therefore, standing waves having a sufficient electric field intensity to excite the gas within the lamp 5, are produced at a position around the lamp 5, so that the gas within the lamp 5 is sufficiently excited. The standing waves produce a linearly polarized electric field which is stronger than the circularly polarized electric field, thus promoting the initial discharge in the lamp 5. When a complete discharge is created in the lamp 5, the microwaves are completely absorbed by the lamp 5, so that the linearly polarized microwaves are converted again into the circularly polarized microwaves.

As apparent from the above description, the present invention provides a non-rotating electrodeless high-intensity discharge lamp system using circularly polarized microwaves. The lamp system has a waveguide array to propagate microwaves to a discharge lamp therethrough, with an elliptical waveguide arranged in the waveguide array such that the major axis of the elliptical waveguide is rotated to a predetermined angle relative to a horizontal surface of an input waveguide. The lamp system thus effectively converts linearly polarized microwaves into circularly polarized microwaves due to a geometrical structure thereof caused by the angle at which the major axis of the elliptical waveguide is rotated relative to the horizontal surface (or the wider surface) of the input rectangular waveguide, thereby allowing the circularly polarized microwaves to reach the discharge lamp. The lamp system is advantageous in that the lifespan of the discharge lamp is prolonged owing non-rotation of the lamp.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A non-rotating electrodeless high-intensity discharge lamp system using circularly polarized microwaves, comprising:

a first rectangular waveguide to transmit linearly polarized microwaves generated from a microwave source;

an input circular waveguide linearly connected to the first rectangular waveguide;

a second rectangular waveguide closed at an end thereof, and perpendicularly connected to a circumferential surface of the input circular waveguide;

an elliptical waveguide linearly connected to the input circular waveguide such that the major axis of the elliptical waveguide is rotated to a predetermined angle relative to a horizontal surface (or the wider surface) of the input circular waveguide;

a second circular waveguide linearly connected to the elliptical waveguide with a conductive end plate; and a discharge lamp housed in a mesh cover or perforated or apertured metallic cover, and supported by the second circular waveguide while being held on a reflecting mirror.

2. The non-rotating electrodeless high-intensity discharge lamp system as set forth in claim 1, further comprising a mode filter provided on an interface between the input circular waveguide and each of the first and second rectangular waveguides.

3. The non-rotating electrodeless high-intensity discharge lamp system as set forth in claim 1, wherein the predetermined angle at which the major axis of the elliptical waveguide is rotated relative to the horizontal surface (or the wider surface) of the input rectangular waveguide, is set to 40~50° when the elliptical waveguide has a minor-axis diameter of 80 mm and a major-axis diameter of 108 mm in the case of the frequency of 2.45 GHz.

4. A non-rotating electrodeless high-intensity discharge lamp system using circularly polarized microwaves, comprising:

a rectangular waveguide to propagate linearly polarized microwaves generated from a microwave source;

an elliptical waveguide linearly connected to the rectangular waveguide such that the major axis of the elliptical waveguide is rotated to a predetermined angle relative to a horizontal surface of the rectangular waveguide, with one or more stubs inserted in the elliptical waveguide;

a circular waveguide linearly connected to the elliptical waveguide; and a discharge lamp housed in a mesh or perforated or pertured cover, and supported by the circular waveguide while being held on a reflecting mirror.

5. The non-rotating electrodeless high-intensity discharge lamp system as set forth in claim 4, wherein four stubs are inserted in the elliptical waveguide.

* * * * *